United States Patent [19]

Fabrig

[11] 4,161,196

[45] Jul. 17, 1979

[54] METHOD AND APPARATUS FOR MAKING SPIRAL BINDER NOTE BOOKS

[75] Inventor: Paul Fabrig, Neuffen, Fed. Rep. of Germany

[73] Assignee: Womako-Maschinenkonstruktionen GmbH, Nürtingen, Fed. Rep. of Germany

[21] Appl. No.: 854,818

[22] Filed: Nov. 25, 1977

[30] Foreign Application Priority Data

Nov. 25, 1976 [DE] Fed. Rep. of Germany ..... 2653527
Jul. 27, 1977 [DE] Fed. Rep. of Germany ..... 2733820

[51] Int. Cl.[2] ..... B21F 15/00

[52] U.S. Cl. ..... 140/92.4; 140/92.7; 11/1 R

[58] Field of Search ..... 140/92.3, 92.4, 92.7, 140/92.9; 83/907; 11/1 R, 1 AC

[56] References Cited

U.S. PATENT DOCUMENTS

| | | | |
|---|---|---|---|
| 2,963,049 | 12/1960 | Biel et al. | 140/92.3 |
| 3,924,664 | 12/1975 | Pfaffle | 140/92.7 |
| 3,924,665 | 12/1975 | Spuhl | 140/92.7 |
| 3,972,109 | 8/1976 | Sickinger | 140/92.7 |

*Primary Examiner*—Lowell A. Larson

*Attorney, Agent, or Firm*—Peter K. Kontler

[57] ABSTRACT

Note books or pads whose leaves are held together by spiral binders are produced during transport of their constituents along an elongated path between two parallel planes. Stacks of elongated sheets are inserted into a first portion of the path so that the sheets extend transversely of the direction of their stepwise advance. Each stack is thereupon subdivided into several smaller stacks, and each smaller stack is provided with a row of perforations extending transversely of the longitudinal direction of the path before the smaller stacks are reassembled into larger stacks each containing a number of sheets corresponding to the number of leaves in a pad. The reassembled larger stacks are thereupon severed in one or more planes which are parallel to the planes flanking the path, and the perforations of each group of resulting pads are aligned in one or more stages for introduction of elongated spirals which are severed to yield discrete binders, one for each pad of the respective group. The end portions of the binders are bent toward each other immediately following the spiral severing step. The first section of the path is planar, and the second section of the path is defined by an indexible turret which is adjacent to the aligning, spiral inserting and spiral severing instrumentalities.

15 Claims, 18 Drawing Figures

1
3
4
6
6a
6b
7
8
8a
9
11
12
13
14
16
17
18
19
21
22
23
24
X
Y 36
96
77
79
94a
78
92A
94b
92B
91
37
97
101
100
92a
92b
124
95
39
93A
102
39
121
99
38
29
39
29
93
122
125
98
38
29
39
32

METHOD AND APPARATUS FOR MAKING SPIRAL BINDER NOTE BOOKS

BACKGROUND OF THE INVENTION

The present invention relates to a method and apparatus for making notebooks or pads whose leaves are held together by spiral binders consisting of metallic or synthetic plastic material. More particularly, the invention relates to improvements in a method and apparatus for the mass production of such pads.

Presently known automatic apparatus for the manufacture of note books or pads whose leaves or sheets are held together by spiral binders process a continuous web of paper or like sheet material. The web is withdrawn from a bobbin and is caused to pass through an imprinting mechanism so that it can be converted into leaves of ruled pads. Both marginal portions of the running web are provided with rows of performations by means of rotary punching tools and the web is thereupon halved, i.e., it is severed midway between its perforated marginal portions. In the next step, the resulting narrower webs are severed crosswise so that each thereof yields a row of discrete sheets or leaves having a size corresponding to that of the leaves in a finished pad. Successive sheets of each row are caused to overlap each other, i.e., to form scalloped streams, and the two rows of overlapping sheets are moved apart, i.e., transversely to the longitudinal direction of the rows. In the next step, each row is converted into discrete pads each of which contains a predetermined number of sheets or leaves. The two rows of pads are thereupon advanced in stepwise fashion along discrete paths wherein the perforations of successive pads are aligned for introduction of binders. The ends of such binders are trimmed and deformed.

The just described automatic apparatus are suitable for the mass production of pads with leaves having a predetermined size. The output of such apparatus is limited due to the relatively slow operation of imprinting mechanism, i.e., the output is lower than that which is warranted by the intervals required for other stages of the processing and assembling operation.

It is also known to manufacture spiral binder pads by resorting to semiautomatic apparatus. In such apparatus, stacks of imprinted (ruled) sheets are inserted by hand, and the length of each sheet equals the combined width of two finished pads. The stacks are transported stepwise during travel along a first section of their path, and each stack is converted into several smaller stacks whose sheets are perforated prior to reassembly of smaller stacks into larger stacks. The perforating step involves applying a row of perforations to one edge portion of each smaller stack, namely to an edge portion which extends in parallelism with the direction of transport of smaller stacks. The direction of reassembled (larger) stacks is thereupon changed by 90 degrees, and each stack is halved to yield a pair of pads. The pads of each pair are moved apart so that the width of the gap between two neighboring pads is a multiple of the distance between a pair of neighboring perforations. A spiral is introduced into the perforations of each pair of spaced-apart pads, and the spiral is trimmed between the respective pads to yield two binders, one for each pad. The intermediate portion of each spiral is discarded.

The output of the just described semiautomatic apparatus is limited due to relatively low speed of the punching mechanism. Proposals to employ sheets whose length equals three times the width of a pad have met with limited success because the utilization of longer sheets necessitates a lengthening of intervals between successive stepwise advances of the sheets and pads.

OBJECTS AND SUMMARY OF THE INVENTION

An object of the present invention is to provide a novel and improved method of making note books or pads, whose leaves are held together by spiral binders, which can be resorted to for more economical production of pads.

Another object of the invention is to provide a method which renders it possible to produce a large number of pads per unit of time, which can be practiced without any waste in the material of binders and with negligible waste (if any) in the material of the leaves, and which can be resorted to for the manufacture of pads having sheets or leaves of any desired size and/or shape.

A further object of the invention is to provide a novel and improved apparatus for the practice of the above outlined method.

An additional object of the invention is to provide an apparatus whose space requirements are surprisingly small in spite of its substantial output, which requires a minimum of attention, which can be supervised and/or serviced by semiskilled or unskilled persons, and wherein all operations can be observed to insure that a malfunction is detected without any delay even if the apparatus is not equipped with automatic controls.

Another object of the invention is to provide the apparatus with novel and improved transporting means for stacks of sheets and pads.

An ancillary object of the invention is to provide the apparatus with novel and improved means for positively but adjustably transporting pads on their way toward, past and beyond the spiral inserting station.

A further object of the invention is to provide an apparatus which insures accurate alignment of perforations in pads prior to introduction of spirals and which can convert spirals into binders without any waste in the metallic or plastic material of the spirals.

One feature of the invention resides in the provision of a method of assembling and converting elongated metallic or plastic spirals and elongated sheets (which may consist of paper or other suitable material) into note books or pads whose leaves are held together by binders each of which constitutes a portion of a spiral. The method includes the steps of establishing an elongated path between two parallel planes (such path can be established by several conveyors including endless belts or chains, grippers and/or one or more indexible turrets disposed in a line one behind the other), assembling a series of successive first stacks (each consisting of elongated sheets) in a first portion of the path including positioning the elongated sheets transversely of the longitudinal direction of the path (the assembling step may include manually feeding relatively high stacks of elongated sheets into the first portion of the path), breaking up or subdividing the first stacks into smaller second stacks in a second portion of the path (this step may include halving each first stack or breaking up each first stack into three or more second stacks), applying a row of perforations to a longitudinally extending edge portion of each second stack in a third portion of the path (the perforating means preferably extends transversely of the path and is preferably adjacent to the trailing edge portion of a second stack in the third portion of the path), collecting several successive second stacks into larger third stacks in a fourth portion of the path (the number of sheets in each third stack may but need not equal the number of sheets in a first stack), subdividing successive third stacks into groups of registering pads in a fifth portion of the path including severing each third stack in at least one plane which is parallel to the aforementioned planes bounding the elongated path (the severing step may include trimming the outer sides of the outermost pads of each group of registering pads), aligning the perforations of successive groups of registering pads in at least one additional portion of the path (such aligning step may include imparting to each set of aligned perforations an arcuate shape corresponding to the curvature of convolutions of a spiral, and such shape imparting operation can be carried out in one or more stages), introducing spirals into aligned perforations of successive groups of pads in a further portion of the path (this step may include forming the spirals from metallic or plastic wire and introducing the spirals into the perforations of the adjacent group of pads as the spirals are formed), and severing successive spirals in still another portion of the path so that each spiral yields several discrete binders, one for each pad of the respective group.

The method preferably further comprises the step of bending the free end portions of discrete binders, preferably in the opposite directions so that the tips of the deformed end portions face each other.

The path preferably includes an arcuate section and the aforementioned additional portion, further portion and still another portion of the path then form part of the arcuate path section. The first section of the path may but need not be a planar (e.g., horizontal) section. If the first section is planar, the first to fifth portions of the path preferably form part of such first section.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1A, 2A:
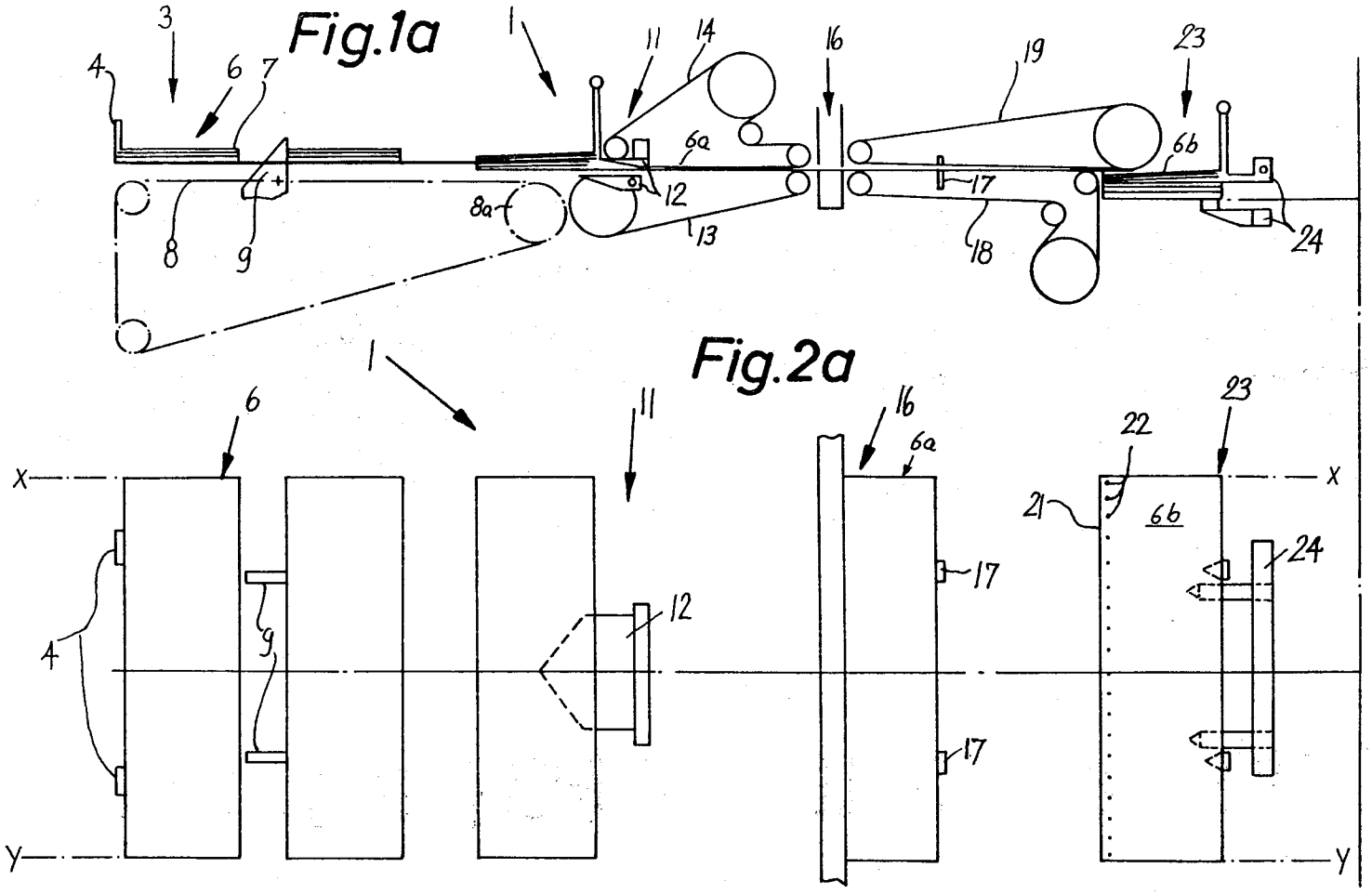
FIG. 1*a* is a schematic side elevational view of a first portion of an apparatus which embodies the invention.
FIG. 2*a* is a schematic plan view of the structure which is shown in FIG. 1*a;*

Referring first to FIGS. 1*a,* 1*b,* 2*a* and 2*b,* the apparatus which is shown therein comprises an elongated straight first transporting and processing section 1 and an arcuate second transporting and processing section 2 which is located behind the section 1, as considered in the direction of transport of processed material.

The first section 1 includes a feeding or stack assembling station 3 wherein elongated sheets 7 of paper or the like are placed by hand against a locating stop 4 so that the sheets 7 form a stack 6. The length of the sheets 7 (as considered at right angles to the plane of FIG. 1*a*) is several (e.g., four) times the width of a note book or pad 29 (see FIGS. 2*b* and 9). The sheets 7 are placed against the locating stop 4 during the intervals of idleness of an intermittently operated endless sheet transporting belt conveyor 8 having one or more entraining elements 9 which can bypass the two-piece stop 4 (see FIG. 2*a*) to advance a freshly formed stack 6 in a direction to the right, as viewed in FIG. 1*a* or 2*a*. The means for intermittently driving the conveyor 8 is of conventional design and is not shown in the drawing. Such driving means can transmit torque to the shaft of one of the pulleys 8*a* for the conveyor 8.

The entraining element 9 transport successive stacks 6 to a subdividing unit 11 which breaks up each stack 6 into a series of smaller stacks 6*a* (e.g., into two stacks of equal height). To this end, the subdividing unit 11 comprises a blade-like proportioning device or tongs 12 which extends into the path of movement of the front side of an oncoming stack 6. Successive smaller stacks 6*a* are engaged and transported by the neighboring reaches of two endless belt conveyors 13 and 14. The gap between the conveyors 13 and 14 is located in or close to the plane of the upper reach of the conveyor 8. The stacks 6*a* which are transported by the conveyors 13 and 14 are brought to a halt in a punching or perforating unit 16 which includes suitable means (not specifically shown) for providing the trailing portion of each stack 6*a* with a row of equally spaced holes or perforations 22 (shown in FIG. 2*a*). Each row of perforations 22 extends at right angles to the direction of movement of the stacks 6a. Each stack 6a which is provided with a row of perforations 22 is engaged and transported by the neighboring reaches of two intermittently driven endless belt conveyors 18 and 19 which deliver successive stacks 6a to a collecting or stacking unit 23. The conveyors 18, 19 are provided with aligned stops 17 which extend into the path of movement of an oncoming stack 6a and arrest the stack in an optimum position with respect to the perforating unit 16 so that the distance between the row of perforations 22 and the rear end face 21 of each stack 6a is the same.

The collecting unit 23 converts several successive perforated stacks 6a into a larger stack 6b wherein the number of sheets 7 may but need not equal the number of sheets in a stack 6. The number of sheets 7 in each stack 6b equals the number of sheets or leaves in a pad 29. The means for withdrawing successive stacks 6b from the collecting unit 23 comprises a mobile gripping or transferring device 24 with two sets of jaws which are movable into engagement with the uppermost and lowermost sheets of successive stacks 6b. The transferring device 24 can advance successive stacks 6b through a distance which suffices to move such stacks into the range of intermittently driven entraining elements or pushers 26 shown in FIGS. 1b and 2b. Each pusher 26 preferably comprises several aligned teeth or like components which engage spaced-apart portions of the rear end face of the respective stack 6b. The pushers 26 are mounted on an endless conveyor belt or chain (not specifically shown) which transports them along an endless path having a horizontal upper portion which is shown in FIGS. 1b and 2b.

The pushers 26 advance successive stacks 6b into the range of a severing unit 27 having three knives 28 which are parallel to the direction of movement of pushers 26 and descend when the stack 6B therebelow is idle to thus convert such stack into four aligned note books or pads 29. If desired, the severing unit 27 may comprise two additional knives 28a which trim the respective lateral marginal portions of the stack 6b at the severing station. The pushers 26 thereupon transport successive groups or sets of four registering pads 29 each to the first station of an intermittently driven rotary conveyor or turret 32 which is indexible about a horizontal axis 35 normal to the direction of movement of pads 29 with the pushers 26. The pushers 26 deliver successive groups of pads 29 into successive holders 38 of the turret 32 at the nine o'clock position of the turret, as viewed in FIG. 1b. The respective pushers 26 are thereupon returned in a direction to the left, as viewed in FIG. 1b, to engage and entrain freshly assembled stacks 6b in the region of the gripping device 24.

Figure 1B:
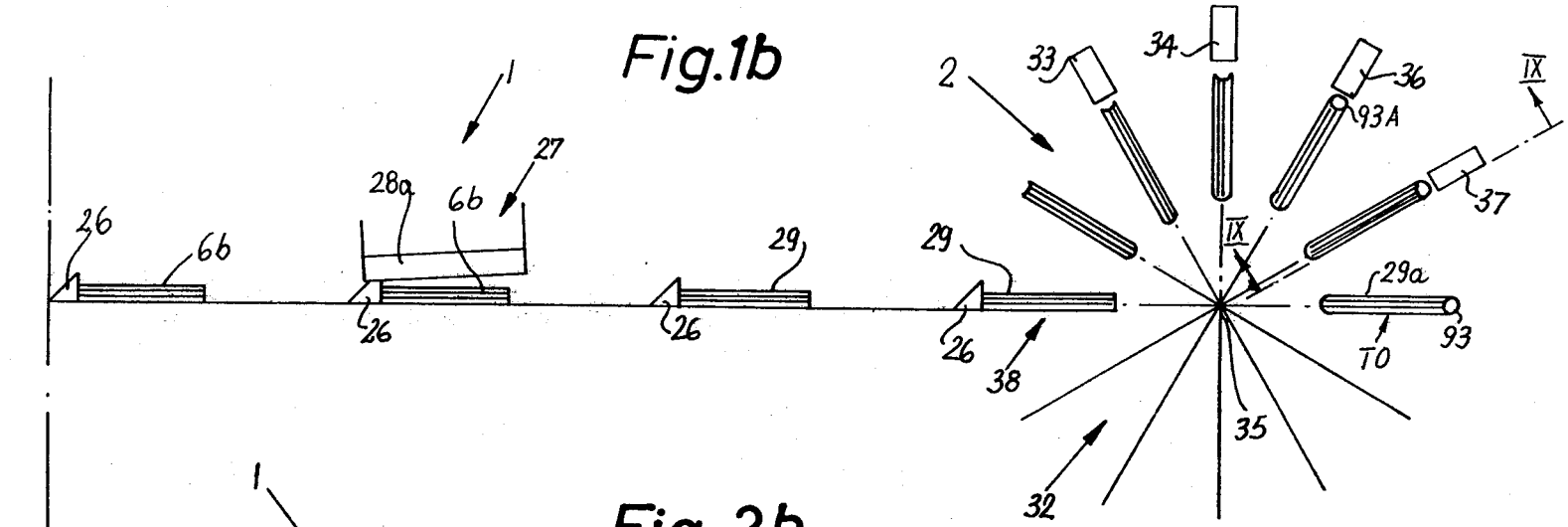
FIG. 1*b* is a schematic side elevational view of a second portion of the apparatus.
Figure 2B:
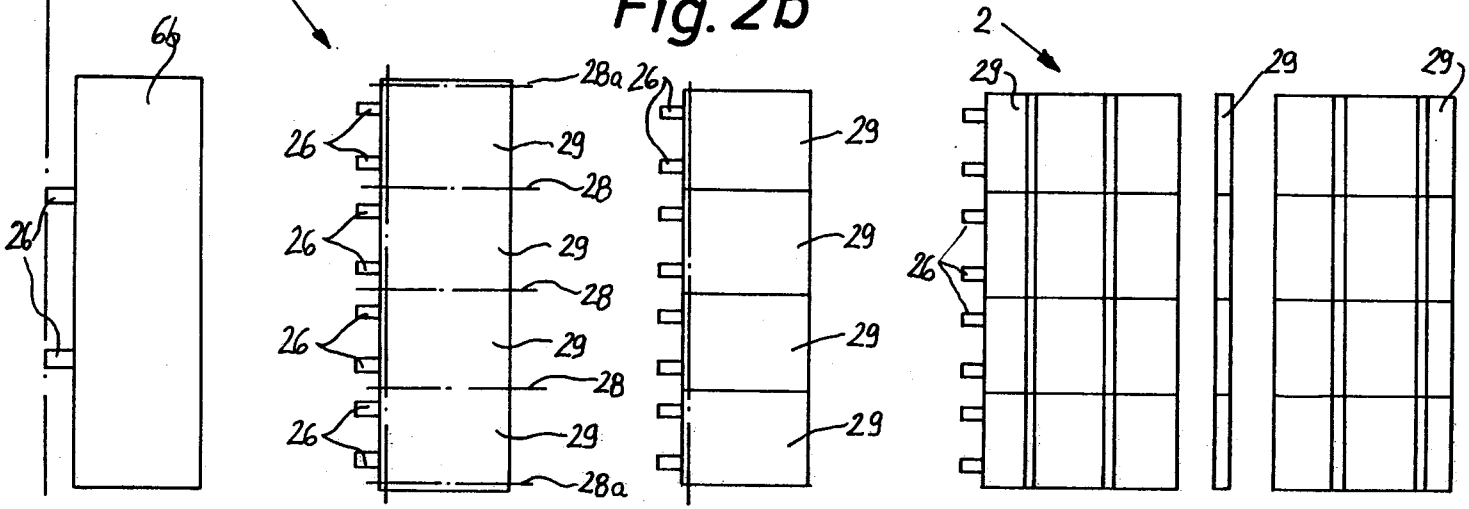
FIG. 2*b* is a schematic plan view of the structure which is shown in FIG. 1*b;*
Figure 3A:
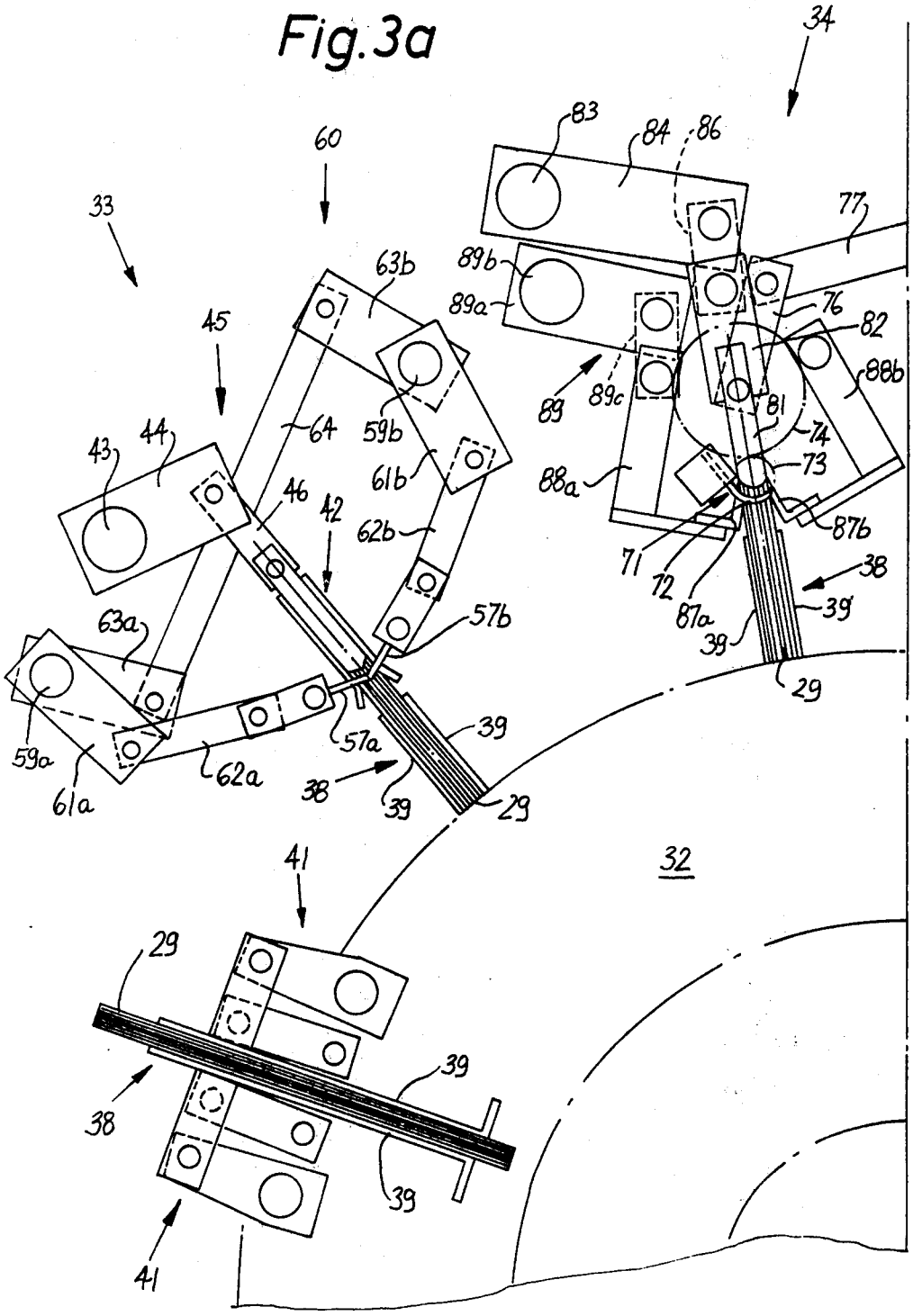
FIG. 3*a* is a schematic end elevational view of the upper left-hand portion of a turret-shaped conveyor in the structure of FIG. 1*b,* further showing two perforation aligning units adjacent to the conveyor.
Figure 3B:
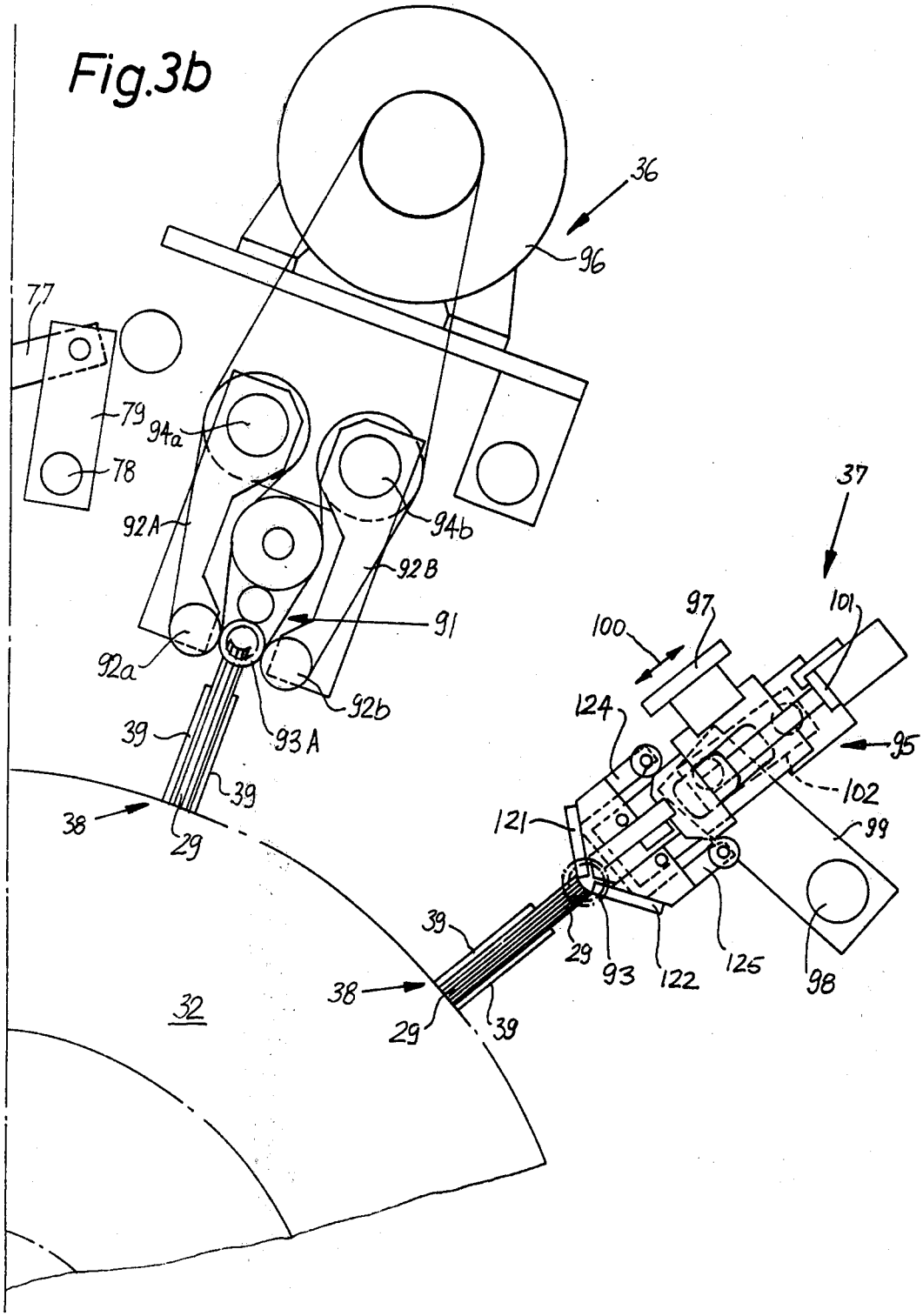
FIG. 3*b* is a schematic end elevational view of the upper right-hand portion of the turret-shaped conveyor in the structure of FIG. 1*b,* further showing a spiral inserting unit and a spiral severing and binder deforming unit.

FIGS. 1b, 3a and 3b show that the turret 32 transports successive groups of pads 29 past a first aligning unit 33 (located at or close to the eleven o'clock position), thereupon past a second aligning unit 34 (located at or close to the twelve o'clock position), past a spiral introducing unit 36 (located at or close to the one o'clock position), past a wire trimming or severing and deforming unit 37 (located at or close to the two o'clock position) and finally to a take-off station T0 at which the groups of fully assembled (finished) pads 29a (each having a spiral binder 93) are removed from the turret 32 for delivery to storage, to a conveyance or to a further processing station, not shown.

Each holder 38 of the turret 32 defines a chamber which can receive an entire group of four registering pads 29, and each of these holders comprises gripping means consisting of two spaced-apart jaws or claws 39 at least one of which can be moved toward and away from the other jaw by means of a linkage 41 (FIG. 3a) receiving motion at predetermined intervals from a cam (not specifically shown) which is preferably mounted on the shaft for the turret 32. When the jaws 39 are moved to their operative positions, they engage and grip the respective outermost sheets of the group of registering pads 29 in the corresponding holder 38 but leave the perforated portions of the pads exposed (see also FIG. 9). The configuration of the aforementioned actuating cam for the linkages 41 of the holders 38 is such that the jaws 39 of each holder 38 move apart at the nine o'clock position of the turret 32 (in order to receive a fresh group of registering pads 29), at the eleven o'clock position (in order to allow for first or preliminary alignment of sheets which constitute the respective group of registering pads 29), at the twelve o'clock position (in order to allow for a second or final alignment or adjustment of sheets which constitute the respective group of registering pads 29), and at the three o'clock position to allow for removal of finished pads 29a from the respective holder 38.

FIGS. 4 to 8 illustrate the details of the first aligning unit 33. The unit 33 comprises a substantially U-shaped pattern or jacket 42 which is shiftable radially toward and away from the turret 32 by a mechanism 45 including a stationary guide (not shown) wherein the jacket 42 is movable back and forth. The shifting mechanism 45 further comprises a pivotable lever 44 which is mounted on a fixed shaft 43 and is articulately connected with the jacket 42 by a link 46. The jacket 42 comprises two substantially parallel plates 47 and 48 which define a compartment 49 for the reception of a group of four registering pads 29. The width of the compartment 49 (as considered at right angles to the planes of the major portions of the plates 47 and 48) equals or approximates the thickness of a pad 29. The inner end portions 51, 52 of the plates 47, 48 (i.e., those end portions which are nearer to the turret 32) flare outwardly to insure unimpeded entry of a group of registering pads 29 into the compartment 49 when the jacket 42 is moved toward the axis 35 of the turret 32.

Figure 4:
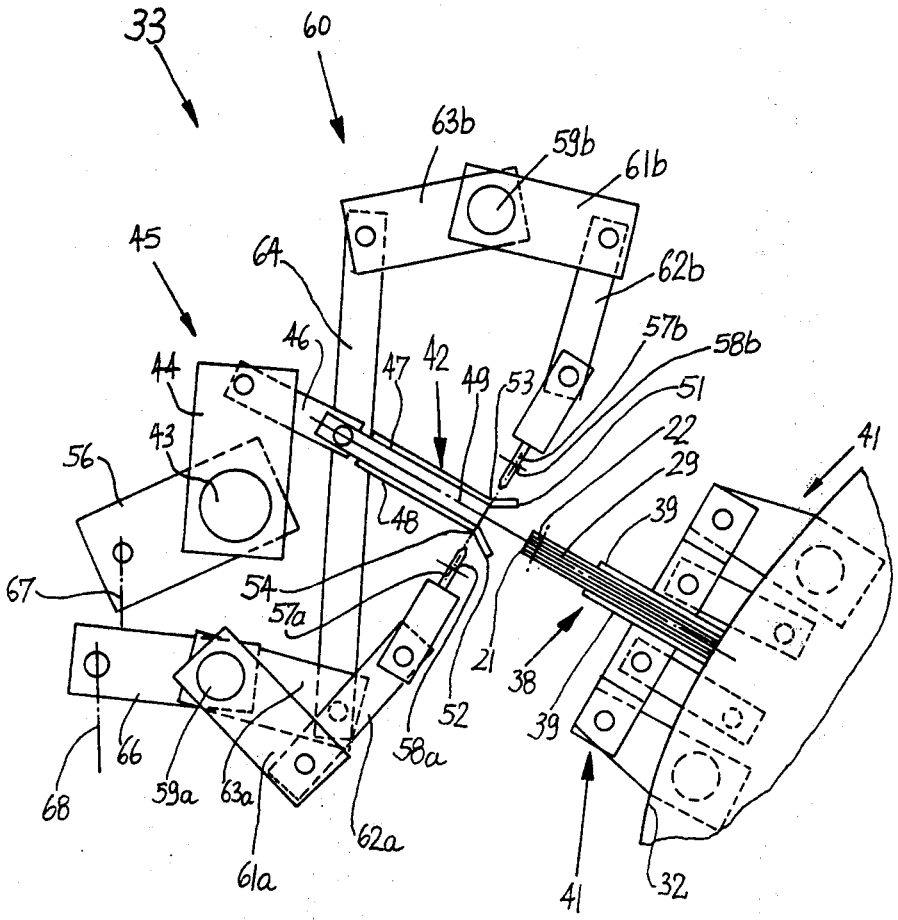
FIG. 4 illustrates the details of the first aligning unit of FIGS. 1*b* and 3*a;*
Figure 5:
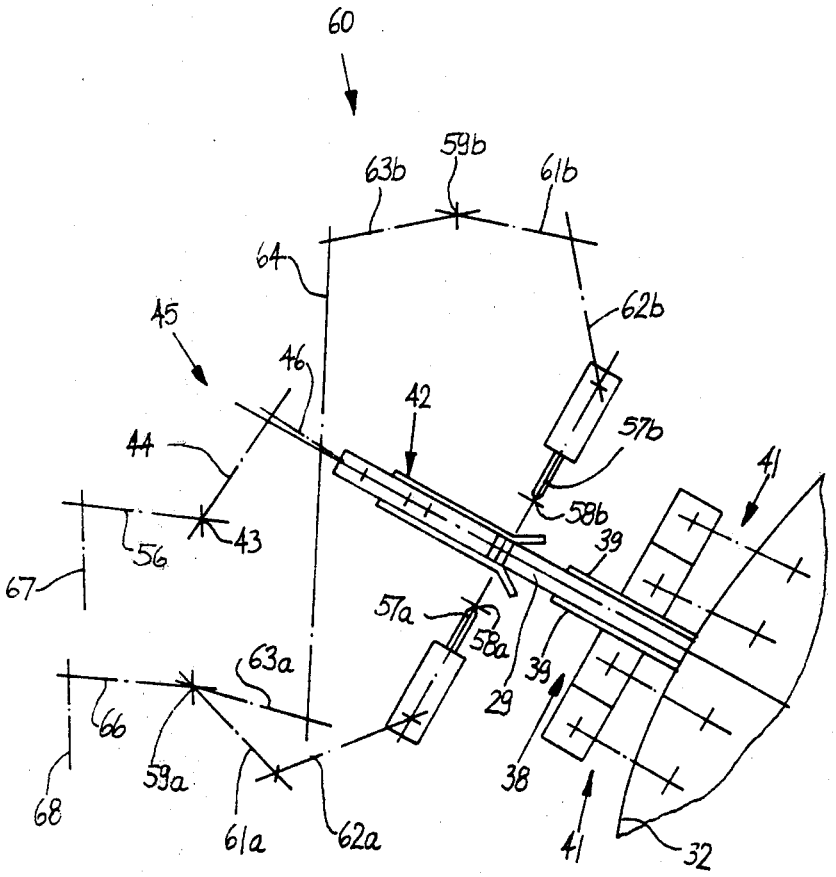
FIG. 5 is a schematic view of the first aligning unit of FIG. 4, with the parts of the aligning unit shown in different positions.

The plates 47, 48 are respectively formed with rows of apertures 53, 54 which register with the perforations 22 of a group of pads 29 in the adjacent holder 38 when the jacket 42 is moved from the retracted position of FIG. 4 to the first extended position of FIG. 5. The diameters of apertures 53 and 54 preferably equal or approximate the diameters of perforations 22.

Figure 7:
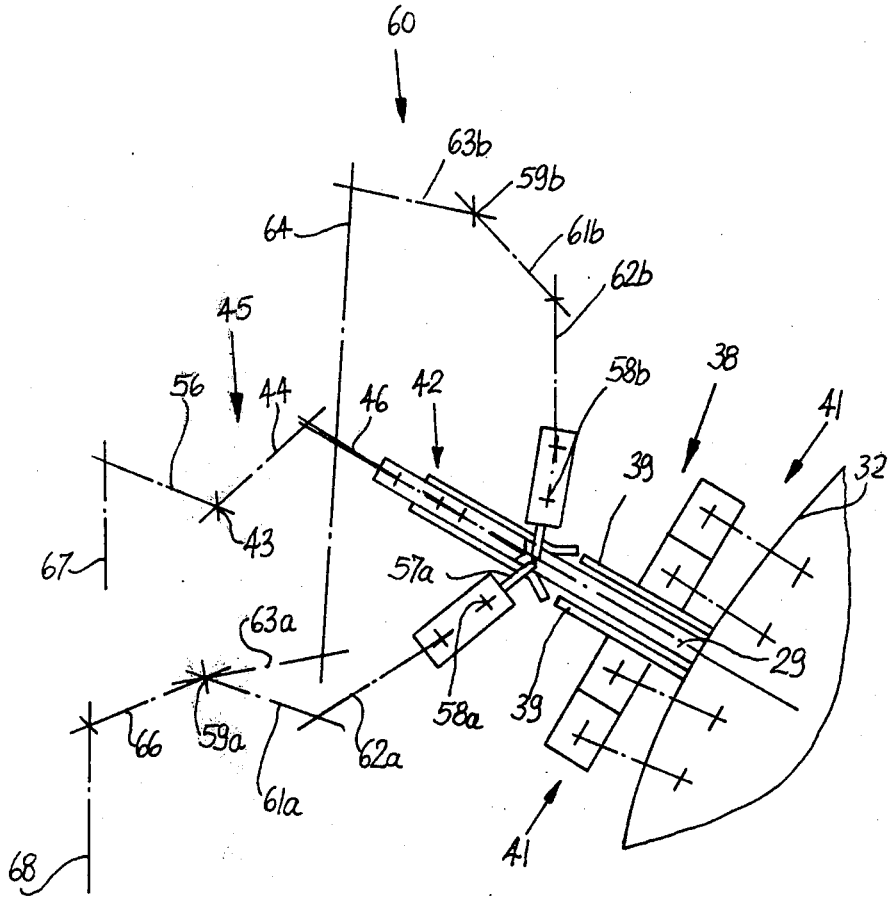
FIG. 7 illustrates the structure of FIG. 6, with the parts shown in different positions.
Figure 8:
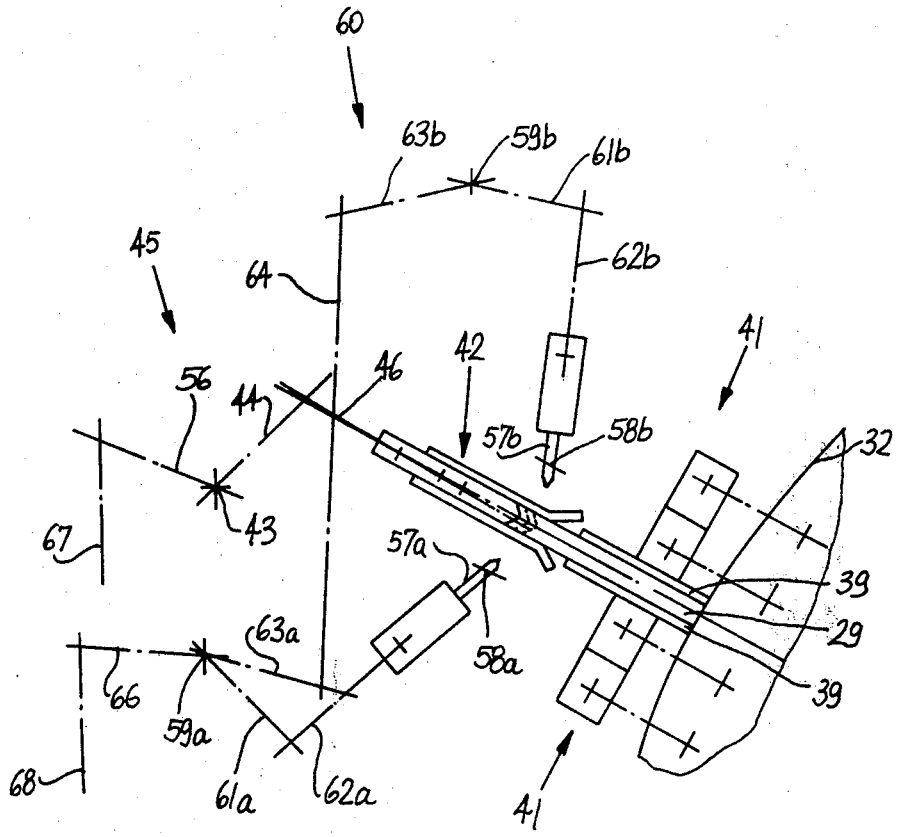
FIG. 8 illustrates the structure of FIG. 7, with the parts shown in different positions.

The means for pivoting the lever 44 of the shifting mechanism 45 back and forth to thereby move the jacket 42 between the positions of FIGS. 4 and 5 and a second extended position which is shown in FIG. 7 comprises a further lever 56 which is mounted on the shaft 43 and is rigid with the lever 44. The lever 56 is pivotable by a suitable drive means (not shown), e.g., by a drive means including a rotary cam.

The jacket 42 is flanked by two rows of pin-shaped mandrels 57a, 57b which respectively register with the apertures 54, 53 of the plates 48 and 47. The jacket 42 carries suitable guide means (not specifically shown) which confines the mandrels 57a, 57b to reciprocatory movement toward and away from the respective apertures 54, 53. Furthermore, the mandrels 57a, 57b are respectively turnable about pivot members 58a, 58b. These pivot members are or can be mounted in the just mentioned guide means of the jacket 42.

The means 60 for moving the two rows of mandrels 57*a* and 57*b* toward each other comprises levers 61*a*, 61*b* which are respectively mounted on fixed shafts 59*a*, 59*b* and are respectively coupled with the corresponding rows of mandrels by links 62*a*, 62*b*. The levers 61*a*, 61*b* are respectively rigid with levers 63*a*, 63*b* which are coupled to each other by a link 64 to insure that axial movements of mandrels 57*a* are synchronized with the movements of mandrels 57*b*. The levers 61*a*, 63*a* are rigid with a further lever 66 which receives motion from the aforementioned drive means for the lever 56, i.e., from the rotary cam. The cam transmits motion to the levers 56 and 66 by means of connecting rods 67 and 68 which are indicated by phantom lines.

The cam of the drive means for the levers 56 and 66 has three raised portions or lobes to operate the first aligning unit 33 in the following way: The parts of the unit 33 assume the starting or idle positions of FIG. 4 when a holder 38 with a group of registering pads 29 approaches the position shown in FIG. 4. The turret 32 is arrested when the pads 29 in such holder 38 register with the jacket 42 (which is retracted). The aforementioned cam of the drive means for the levers 56 and 66 then causes the jacket 42 to move radially toward the turret 32 so that the apertures 53 and 54 are placed into register with the perforations 22 of the pads 29 at the first aligning station. The aforementioned guide means of the jacket 42 compels the two rows of mandrels 57*a* and 57*b* to share such movement of the jacket; however, the configuration of the cam which transmits motion to the levers 56 and 66 via connecting rods 67 and 68 is such that the angular position of the lever 66 remains unchanged while the jacket moves toward the first extended position of FIG. 5 so that the distance between the mandrels 57*a*, 57*b* and the respective plates 48, 47 of the jacket 42 increases (compare FIGS. 4 and 5). The pivot members 58*a*, 58*b* for the mandrels 57*a* and 57*b* are blocked.

Figure 6:
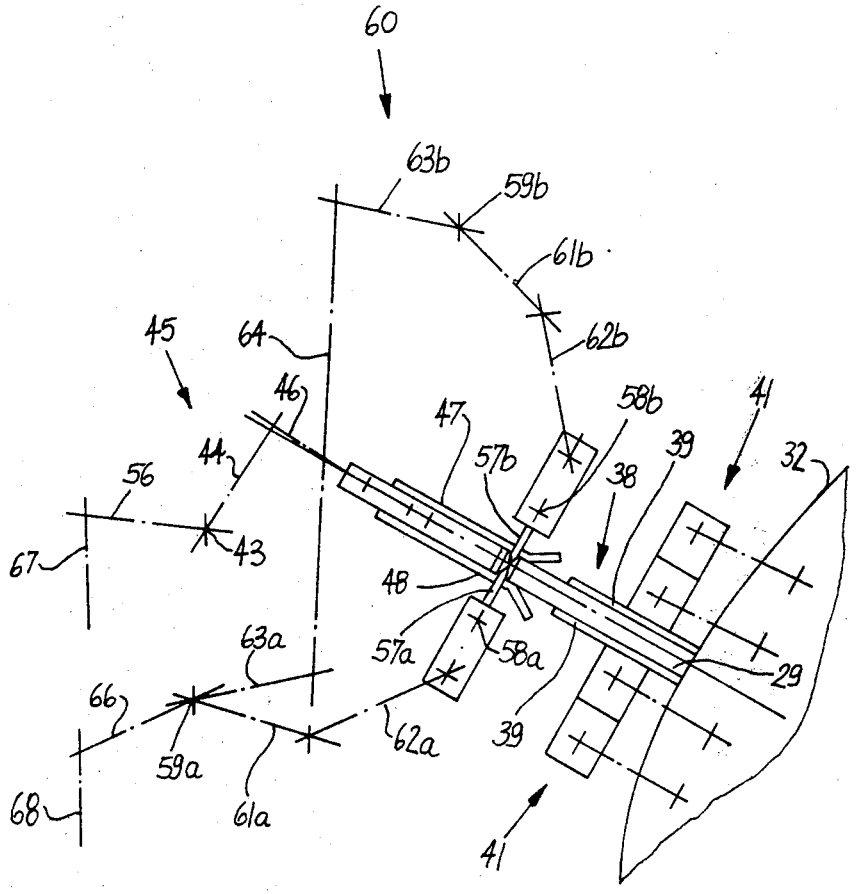
FIG. 6 illustrates the structure of FIG. 5, with the parts shown in other positions.

During the next stage of rotation of the cam which transmits motion to the connecting rods 67 and 68, the jacket 42 remains in the position of FIG. 5 and the connecting rod 68 pivots the lever 66 in a direction to move the two rows of mandrels 57*a* and 57*b* toward each other so that the tips of the mandrels penetrate into the respective perforations 22 of the pads 29 in the compartment 49. The tips of the mandrels 57*a* can acutally engage (abut against) the tips of the aligned mandrels 57*b* (see FIG. 6). The pivot members 58*a*, 58*b* are released when the mandrels 57*a* and 57*b* reach the positions which are shown in FIG. 6. The aforementioned cam for the linkage 41 of the holder 38 at the first aligning station thereupon moves the jaws 39 of such holder away from each other, i.e., the pads 29 which extend into the compartment 49 of the jacket 42 are released by the holder 38 so that their sheets can be moved relative to each other in response to pivoting of the mandrels 57*a* and 57*b* from the positons of FIG. 6 to those shown in FIG. 7. Such pivoting of mandrels 57*a* and 57*b* takes place in response to pivoting of the lever 56 by the connecting rod 67 in a direction to move the jacket 42 toward the turret 32, i.e., to the second extended position. The result is that each straight hole consisting of a series of registering perforations 22 is converted into a substantially V-shaped passage which is shown in FIG. 7. The configuration of each V-shaped passage resembles the curvature of convolutions of a spiral 93A.

The cam on the shaft of the turret 32 thereupon moves the jaws 39 of the holder 38 at the first aligning station (unit 33) toward each other so that the holder 38 engages the pads 29 and maintains the perforations 22 in the positions shown in FIG. 7. The cam for the levers 56 and 66 transmits motion to the connecting rod 68 to withdraw the mandrels 57*a* and 57*b* from the respective perforations 22 as well as from the respective apertures 54 and 53 of the jacket 42 (see FIG. 8), and such cam thereupon causes the rod 67 to pivot the lever 56 in a direction to move the jacket 42 back to the retracted position of FIG. 4. The same procedure is repeated when the next holder 38 advances to the position of register with the jacket 42.

The second aligning unit 34 comprises a comb-like aligning device 71 (hereinafter called comb for short) with a row of hook-shaped prongs 72 whose curvature matches that of the convolutions of a spiral binder 93 (shown in FIGS. 9, 10, 11, 14 and 15), i.e., the radii of curvature of the prongs 72 equal or approximate the radius of a spiral 93A. The comb 71 is rigid with a gear 73 which meshes with a larger gear 74 (both gears are indicated in FIG. 3*a* by phantom lines). The gear 73 can turn back and forth about a fixed axis and the comb 71 shares such movements of the gear 73. The shaft of the gear 74 is fixedly mounted in the frame of the apparatus and the gear 74 is rigidly connected to a lever 76 which, in turn, is articulately connected to a link 77 receiving motion from a lever 79 (see FIG. 3*b*) rotatable about the axis of a fixed shaft 78. The means (e.g., a suitable cam drive) for pivoting the lever 79 back and forth at requisite intervals is not shown in the drawing.

The second aligning unit 34 further comprises a shaping or profiling block 81 which extends along the full length of a group of registering pads 29 at the second aligning station. The profiling block 81 is mounted in or on a carrier 82 which is movable toward and away from the turret 32 by a mechanism including a lever 84 mounted on a fixed shaft 83 and articulately connected to the upper end portion of the carrier 82 by a link 86. The means for pivoting the lever 84 at requisite intervals to move the profiling block 81 into and from engagement with the rear (outer) edge faces of a group of registering pads 29 at the second aligning station may comprise a rotary cam or the like (not shown).

In order to insure that the outer portions of sheets forming the group of registering pads 29 at the second aligning station will be held against spreading apart during forward movement of the profiling block 81, the unit 34 further comprises two elongated pressure plates 87*a* and 87*b* which are mounted at the level of perforations 22 in the group of pads 29 at the second aligning station. The pressure plates 87*a* and 87*b* are respectively mounted on levers 88*a* and 88*b* which can be pivoted back and forth at requisite intervals by a drive 89. This drive comprises a fixed shaft 89*a*, a lever 89*b* on the shaft 89*a*, a link 89*c* which couples the lever 89*b* to the lever 88*a* and suitable means (not shown) for synchronizing the movements of the lever 88*a* with those of the lever 88*b* (however, the levers 88*a* and the 88*b* move in the opposite directions). The synchronizing means is analogous to the parts 63*a*, 63*b*, 64 in the first aligning unit 33. The pressure plates 87*a* and 87*b* have suitable slots, notches, holes or other types of openings for the prongs 72 of the cam 71.

When the turret 32 is in motion, the comb 71 is retracted (to a position to the left of that shown in FIG. 3*a*), the profiling block 81 is also retracted (to a position radially outwardly of and remote from the turret 32), and the levers 88*a* and 88*b* are held in the retracted positions so that the mobile parts of the second aligning unit 34 cannot interfere with indexing of the turret 32 and its holders 38. When a holder 38 reaches the second aligning station (such holder maintains the pads 29 in the positions shown in FIG. 8), the respective linkages 41 cause the jaws 39 to move apart so that the prongs 72 of the comb 71 can deform each V-shaped passage (each such passage consists of a series of registering perforations 22) in a manner as shown in FIG. 3*a*, i.e., the V-shaped passages are converted into arcuate passages whose curvature equals or closely approximates that of the convolutions of a spiral binder 93. It is preferred to relax the pressure upon the outer sides of the outermost sheets of pads 29 at the second aligning station subsequent to entry of prongs 72 into the respective V-shaped passages. The pressure plates 87*a* and 87*b* are moved close to or into contact with the rear or outer edge portions of the outermost sheets of pads 29 at the second aligning station not later than when the profiling block 81 moves inwardly toward the axis 35 of the turret 32 to impart to the rear or outer edge faces of the pads a concave (semicylindrical) profile. The curvature of the inner end face of the profiling block 81 equals or approximates the curvature of prongs 72 and hence the curvature of a binder 93.

It is also possible to employ a stationary profiling block 81 and to provide means for moving the holder 38 at the second aligning station radially outwardly toward the block 81. All that counts is to provide means for effecting a relative movement between the inserted prongs 72 and the sheets of the pads 29 at the second aligning station so as to convert each V-shaped passage into an arcuate passage.

An advantage of the arrangement including the aligning units 33, 34 and the turret 32 with its holders 38 is that the sheets of the pads 29 can be formed with relatively small perforations 22. This is due to the fact that the first aligning unit 33 converts each substantially straight hole (consisting of a series of registering perforations 22) into a V-shaped passage whose configuration approximates or resembles that of an arcuate prong 72. Therefore, the prongs 72 at the second aligning station can be readily inserted into the respective V-shaped passages even if the diameters of perforations 22 are relatively small.

Furthermore, multi-stage conversion of each substantially straight hole into an arcuate passage whose configuration is best suited to receive a portion of a convolution forming part of a spiral 93A is especially desirable when the pads are relatively thick, either because they comprise a large number of leaves or because the leaves are rather thick. It can be said that the first stage involves a coarse alignment which results in conversion of straight holes into passages suited for insertion of arcuate prongs, and that the second stage involves a final or high-precision adjustment which insures that the leader of the spiral 93A does not become stuck during threading of the spiral into a group of registering pads at the station for the spiral inserting unit 36.

The jacket 42 of the first aligning unit 33 performs several useful functions, namely, it supports and moves the two rows of mandrels 57*a*, 57*b* toward and from positions of register with the respective holes of pads 29 at the first aligning station, its apertures 53 and 54 guide the tips of mandrels 57*a*, 57*b* into the respective straight holes from opposite sides of pads 29 at the first aligning station, its compartment 49 prevents undue spreading of leaves of the pads 29 when the jaws 39 of the holder 38 at the first aligning station are moved apart to relax the pressure upon the unperforated portions of outermost leaves of the pads, and it pivots the mandrels during movement from the extended position of FIGS. 5 and 6 to the second extended position of FIG. 7 whereby the mandrels convert each straight hole into a V-shaped passage.

The spiral introducing unit 36 includes a conventional coiling device 91 which converts straight metallic or plastic wire into a spiral 93A. The coiling device 91 is adjacent to the outer edge faces of pads 29 which reach the spiral inserting station (see FIG. 3*b*). The unit 36 further comprises two abutments 92*a*, 92*b* which flank the path of movement of the leader of a spiral 93A into and out of successive sets of perforations 22 (the spiral 93A rotates about its own axis which is normal to the plane of FIG. 3*b*); these abutments extend along the full length of a group of registering pads 29 at the spiral inserting station and are preferably provided with suitable notches, recesses or analogous guide means for the helices of the spiral 93A. The abutments 92*a*, 92*b* are mounted at the free ends of two levers 92A, 92B which are pivotable about the axes of fixed shafts 94*a*, 94*b* so that they can be moved out of the way when a group of registering pads 29 advances toward or away from the spiral inserting station. The means for pivoting the levers 92A and 92B is similar with or analogous to the parts 63*a*, 63*b*, 64 of the first aligning unit 33.

The coiling device 91 of the spiral inserting unit 36 is preferably driven by a discrete prime mover 96, e.g., a variable-speed electric motor. The mode of operation of the spiral inserting device 36 is known in the art; therefore, a detailed description of the manner in which the spiral 93A is formed and threaded into the pads 29 at the station for the unit 36 is not necessary.

Figure 9:
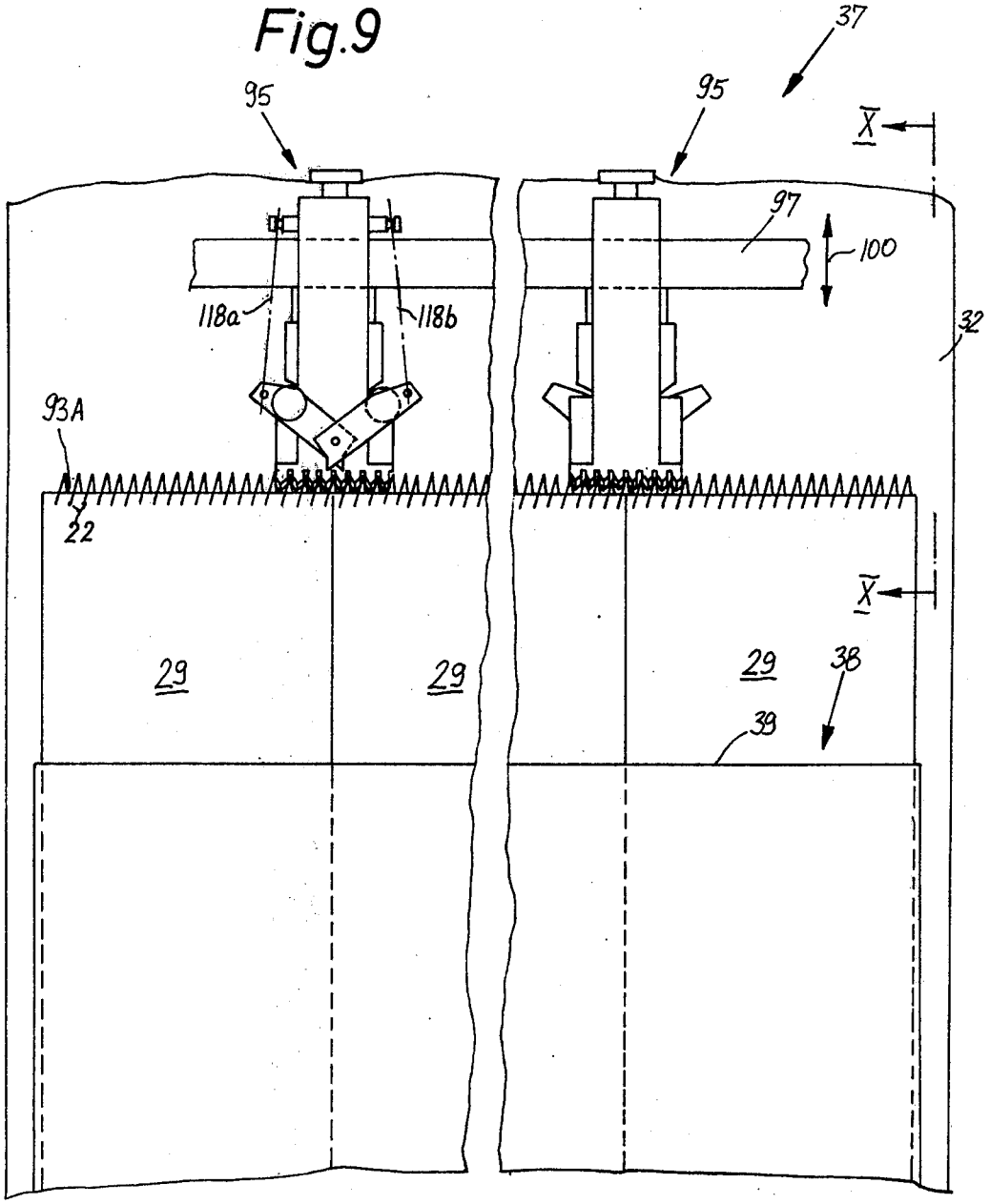
FIG. 9 is an enlarged fragmentary view as seen in the direction of arrows from the line IX—IX of FIG. 1*b;*

The construction of the trimming or severing and deforming unit 37 is shown in detail in FIGS. 9 to 13. FIG. 9 merely shows two of the three trimming or severing and deforming devices or tools 95 which are provided to sever and deform a spiral 93A at the trimming station in order to convert such spiral into four discrete binders 93. The unit 37 further comprises two additional trimming devices or tools (not shown) which merely bend or bend and loop the free ends of the spiral 93A at the trimming station. The construction of such additional trimming tools is similar to but simpler than that of the tools 95 because each additional tool must trim (if necessary) and bend or bend and loop only one end portion of that length of wire which forms a spiral 93A.

The trimming devices or tools 95 are mounted on a common supportig bar 97 which is movable in directions indicated by a double-headed arrow 100, i.e., toward and away from a spiral 93A at the trimming station. An elongated adjusting or displacing member 101 is provided to impart movements to mobile parts of the trimming tools 95 so that the tools can sever the spiral 93A and bend the end portions (namely, portions of the outermost convolutions) of the resulting binders 93. The displacing member 101 receives motion from a lever 99 (see FIG. 3*b* ) mounted on a fixed shaft 98 and articulately connected to the member 101 by one or more links 102.

Figure 10:
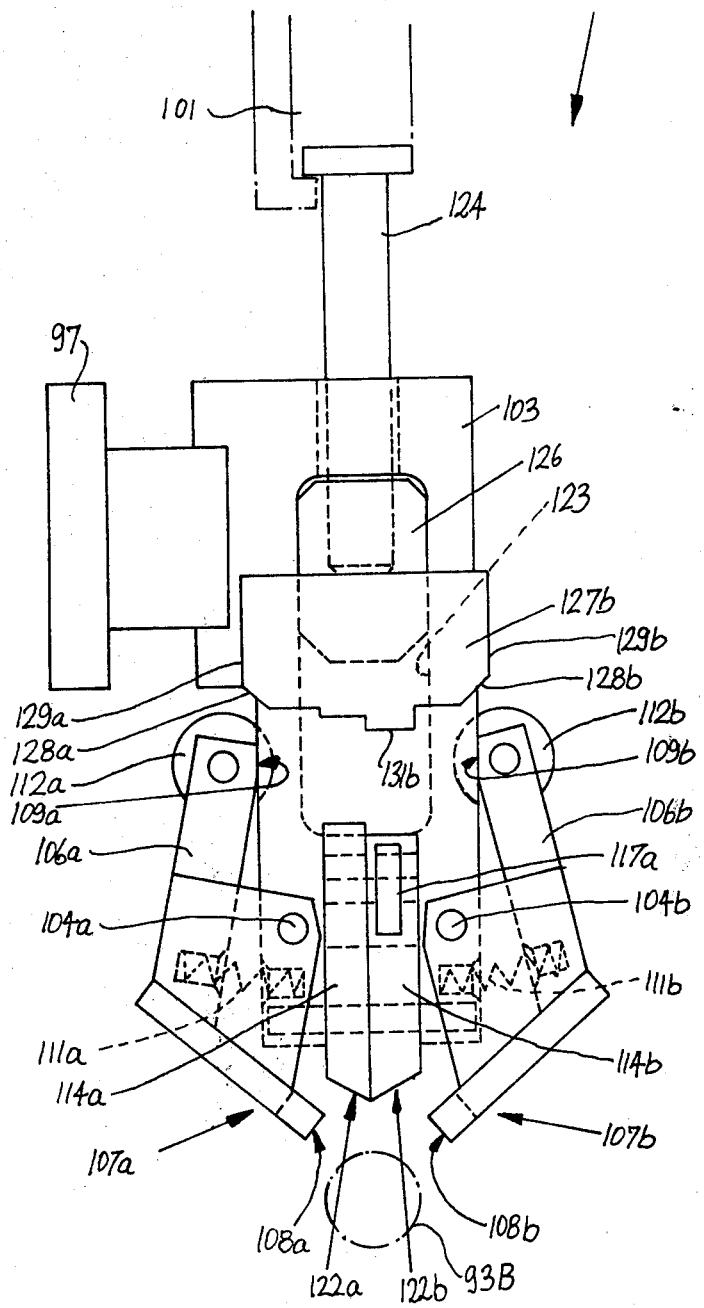
FIG. 10 is an enlarged view as seen in the direction of arrows from the line X—X of FIG. 9, with the pads omitted.

Each trimming device or tool 95 comprises a carriage or support 103 which is secured to the supporting bar 97 and includes two pivot members or shafts 104*a*, 104*b* for bell crank levers 106*a*, 106*b*. The levers 106*a*, 106*b* constitute a means for positioning or locating the convolutions of the spiral 93A by means of spaces 110 between their teeth 108a, 108b. These teeth are provided at the free ends of lower arms or jaws 107a, 107b of the respective bell crank levers. The inclination and distribution of the tooth spaces 110 correspond to the distance between and the lead of helices of the spiral 93A. The upper arms of the bell crank levers 106a, 106b have facetted portions 109a, 109b which normally abut against the carriage 103. The levers 106a, 106b are respectively biased by helical springs 111a, 111b which react against the carriage 103 and tend to maintain the facetted portions 109a, 109b in abutment with the respective side faces of the carriage. The idle positions of the bell crank levers 106a and 106b are shown in FIG. 10. It will be noted that the toothed lower arms 107a, 107b are spaced apart from the convolutions of the spiral 93A. The upper arms of the levers 106a, 106b respectively carry roller followers 112a, 112b.

The axes of the shafts 104a, 104b for the bell crank levers 106a, 106b are parallel to the axis of the spiral 93A at the trimming station. The carriage 103 further includes or supports a pivot member or shaft 113 whose axis is normal to and crosses in space with the axis of the spiral 93A. The shaft 113 supports two levers 114a, 114b which constitute the sections or halves of a cutting implement or shears for the wire of the spiral 93A. The cutting edges 116a, 116b of the sections or levers 114a, 114b sever the wire when the levers are pivoted toward each other from the positions of FIG. 12 to those shown in FIG. 13. The cutting edges 116a, 116b are provided on the shorter lower arms of the levers 114a, 114b; the longer upper arms of these levers carry roller followers 117a, 117b. Furthermore, the free ends of the upper arms of the levers 114a, 114b are connected to helical springs 118a, 118b (shown in FIGS. 9, 12 and 13) whose upper ends are attached to posts 119a, 119b of the carriage 103. The springs 118a, 118b tend to move the cutting edges 116a, 116b on the lower arms of the levers 114a, 114b away from each other.

Figure 12:
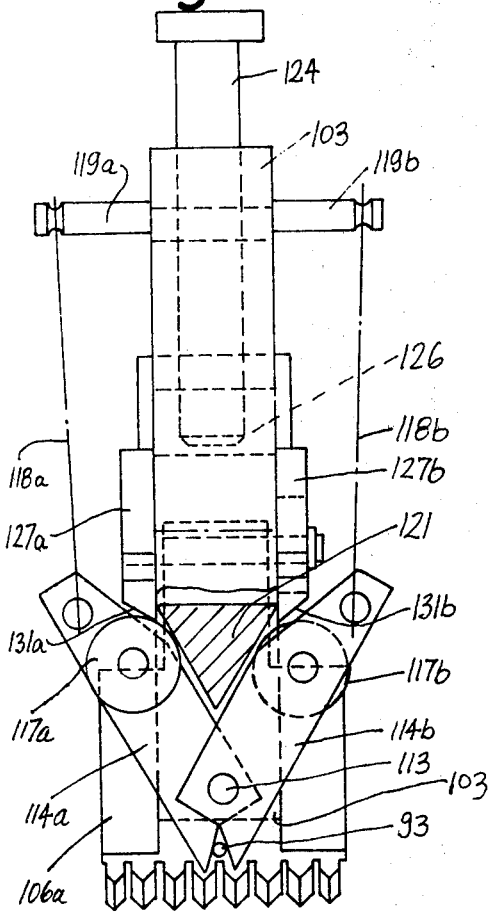
FIG. 12 is an enlarged view of one of the spiral severing units in FIG. 9.
Figure 13:
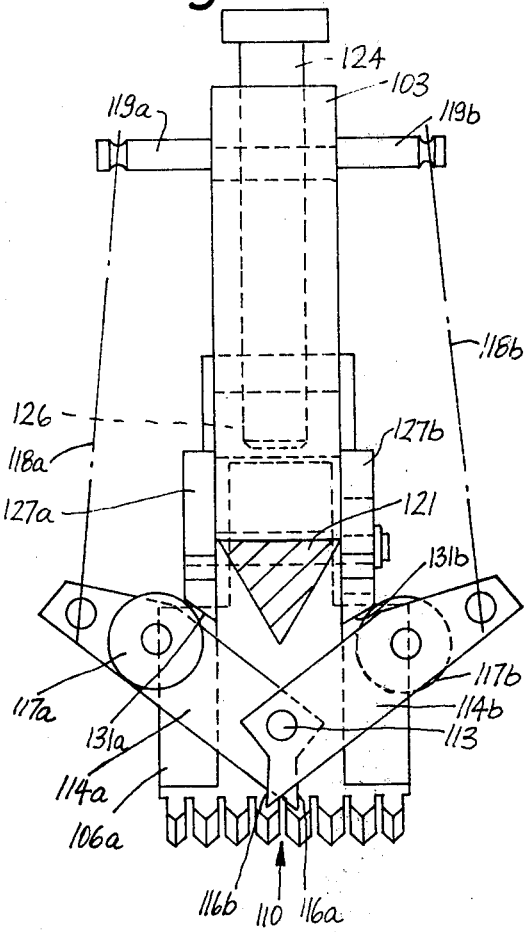
FIG. 13 illustrates the structure of FIG. 12, with the parts shown in different positions.

When the levers 114a, 114b dwell in the inoperative positions of FIG. 12, their roller followers 117a, 117b abut against the respective inclined faces of a wedge-like auxiliary cam 121 which is secured to or forms part of the carriage 103. That portion of the carriage 103 which supports or includes the auxiliary cam 121 is bifurcated. The cutting edges 116a, 116b assume positions in which the wire of the spiral 93A can be moved therebetween preparatory to severing.

In addition to performing a severing operation, the lower arms of the sections or levers 114a, 114b further serve to deform or bend the free end portions of the adjacent binders 93 which are obtained on severing of the spiral 93A. To this end, the lower arms of the levers 114a, 114b are respectively provided with wire deforming portions or shoulders 122a, 122b which are adjacent to the respective cutting edges 116a, 116b. When the toothed jaws 107a, 107b of the bell crank levers 106a, 106b are closed to engage the adjacent convolutions of the spiral 93A, the deforming portions 122a, 122b are parallel to the respective jaws (see FIG. 11).

The carriage 103 further includes guide means or ways 123 for a reciprocable slide 126 which is connected to the displacing member 101 by means of a plunger or rod 124. The displacing member 101 can move the slide 126 toward or away from the spiral 93A at the trimming station. The slide 126 has suitably configurated cams 127a and 127b for the roller followers 112a, 112b of the bell crank levers 106a, 106b. The cams 127a, 127b respectively include inclined first cam faces 128a, 128b and second cam faces 129a, 129b which are parallel to each other and adjacent to the respective first cam faces. In addition, the cams 127a and 127b comprise cam faces 131a and 131b for the roller followers 117a, 117b of the levers 114a, 114b. The slide 126, its cams 127a 127b and the rod 124 can be said to constitute a means for moving the toothed jaws 107a, 107b into engagement with the convolutions of the spiral 93A as well as for moving the cutting edges 116a, 116b (and hence also the shoulders 122a, 122b) toward each other. The jaws 107a, 107b move apart under the action of the springs 111a, 111b, and the lower arms of the levers 114a, 114b move apart under the bias of the springs 118a, 118b.

An important advantage of the improved tools 95 is that they can sever and deform the material of successive spirals 93A between pairs of immediately adjacent pads 29, i.e., it is not necessary to move the pads away from each other prior to introduction of a spiral in order to provide room for movement of tools 95 to their operative positions in which the cutting edges 116a, 116b can sever the wire and the shoulders 122a, 122b can deform the thus obtained end portions 93B while the convolutions at both sides of the severing plane are engaged by the toothed portions 107a, 107b of the levers 106a, 106b. In other words, each tool 95 can replace two conventional tools which are used to sever a spiral at two spaced-apart points between two registering pads which have been moved apart for the express purpose of enabling the conventional tools to perform the severing operations. Moreover, and as mentioned above, each tool 95 can sever a spiral 93A without any waste in the material of the spiral.

Figure 11:
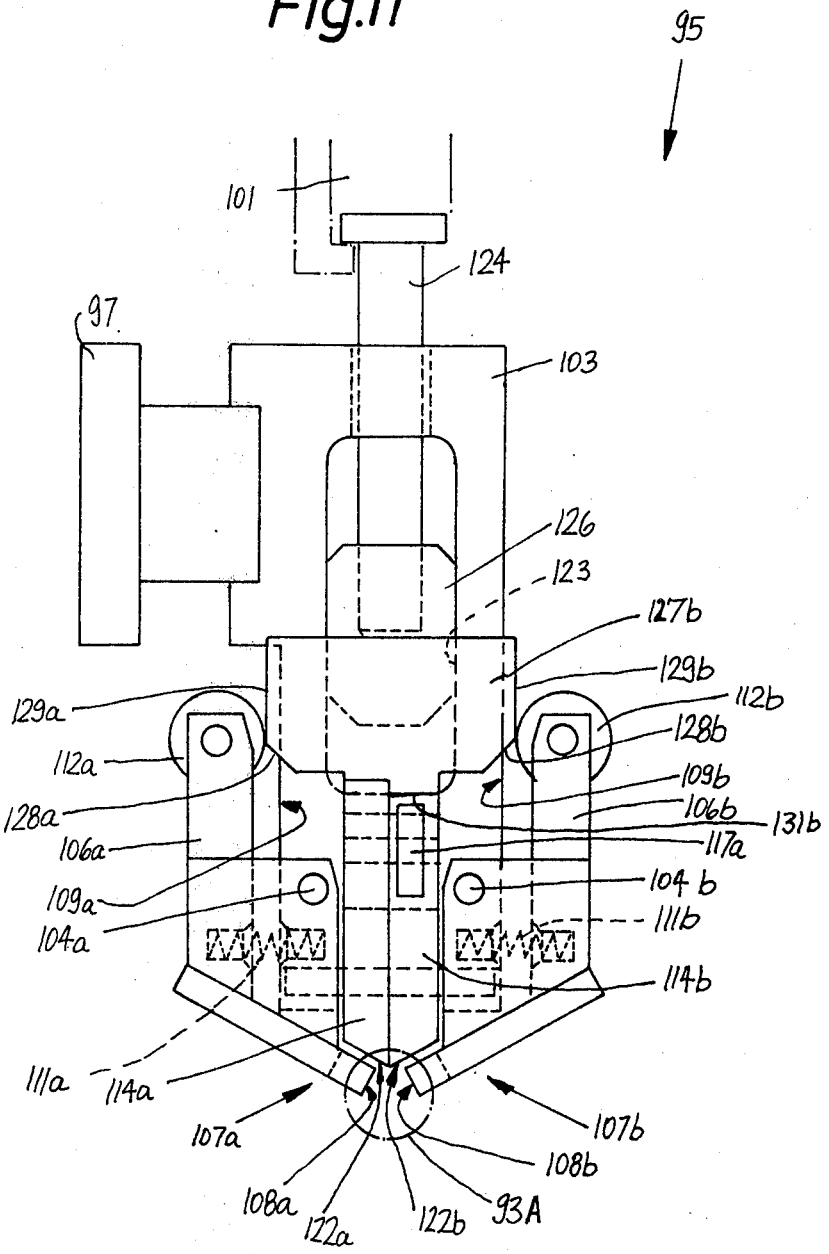
FIG. 11 illustrates the structure of FIG. 10, with the parts shown in different positions.

The operation of the trimming or severing and deforming device or tool 95 which is shown in FIGS. 10 to 13 is as follows:

FIG. 10 illustrates the parts of the tool 95 in their starting or idle positions. Thus, the toothed jaws 107a, 107b of the bell crank levers 106a, 106b and the lower arms of the sections or levers 114a, 114b are remote from the spiral 93A. The supporting bar 97 thereupon moves the support or carriage 103 toward the spiral 93A so that a portion of the spiral extends between the cutting edges 116a, 116b when the carriage 103 reaches its inner end position which is shown in FIG. 11. The cutting edges 116a, 116b thereby perform at least some centering action upon the adjacent portion of the spiral 93A. In the next step, the displacing member 101 is moved toward the turret 32 to move the slide 126 along the ways 123 through the medium of the plunger 124. The faces 128a, 128b of the cams 127a, 127b cause the roller followers 112a, 112b to pivot the bell crank levers 106a, 106b against the opposition of the respective springs 111a, 111b whereby the toothed jaws 107a, 107b move toward the spiral 93A and the tooth spaces 110 receive portions of the adjacent convolutions. This insures that the spiral 93A is properly located for the severing and deforming operations which follow. The jaws 107a, 107b thereupon remain in their operative positions (in which the convolutions of the spiral 93A extend into the tooth spaces 110) because the roller followers 112a, 112b begin to track the parallel cam faces 129a, 129b of the moving cams 127a, 127b.

Figure 14:
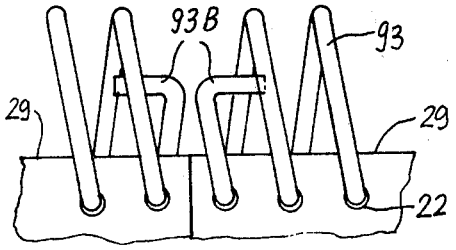
FIG. 14 is an enlarged fragmentary side elevational view of two neighboring pads whose leaves are held together by discrete spiral binders.
Figure 15:
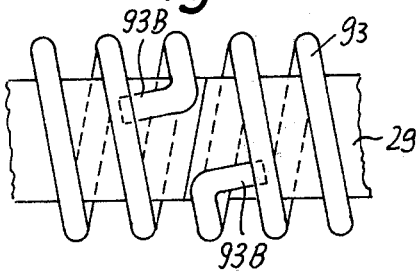
FIG. 15 is a plan view of the pads shown in FIG. 14.

As the slide 126 continues to move toward the axis 35 of the turret 32, the faces 131a, 131b of the cams 127a, 127b reach and displace the roller followers 117a, 117b of the levers 114a, 114b whereby the cutting edges 116a, 116*b* move toward each other and sever the wire of the spiral 93A. The downward or inward movement of the slide 126 continues, i.e., the levers 114*a*, 114*b* continue to pivot whereby their shoulders 122*a*, 122*b* deform the adjacent end portions of the resulting binders 93. As shown in FIGS. 14 and 15, the end portions 93B of the binders 93 are bent toward each other in such a way that they extend in parallelism or substantial parallelism with the axes of the respective binders. In deforming the end portions 93B, the shoulders 122*a*, 122*b* cooperate with the teeth 108*a*, 108*b* of the respective jaws 107*a*, 107*b*.

The displacing member 101 thereupon moves the slide 126 away from the turret 32, and such movement of the displacing member 101 is followed by upward movement of the supporting bar 97 to return all parts of the tool 95 to the positions shown in FIG. 10. This enables the turret 32 to perform an angular movement in a direction to place the next group of registering pads 29 (with a spiral 93A) into requisite position with respect to the tools 95. The finished pads 29*a* are transported to the take-off station TO for detachment from the respective holder 38 and for transport to storage, to a conveyance or to a further processing station.

The just described method and apparatus exhibit a number of important advantages over the aforediscussed conventional automatic and semiautomatic methods and apparatus. Thus, all units of the apparatus can be disposed in a single line, one behind the other, as considered in the direction of transport of sheets 7 and pads 29, because the path along which the sheets and pads move is bounded by two parallel planes (these planes are indicated in FIG. 2*a* by the phantom lines X—X and Y—Y). Moreover, and since the perforating unit 16 extends transversely of the direction of movement of stacks 6*a* along the planar first section 1 of the path (in the illustrated embodiment, the first section 1 is located in a horizontal plane), the step of perforating the sheets 7 of successive stacks 6*a* takes up a very short interval of time regardless of the length of the sheets 7, i.e., regardless of whether each sheet 7 is dimensioned to yield two, three, four, five, six or more leaves of a pad 29. The length of each step which is performed by the stacks 6, 6*a*, 6*b* and groups of registering pads 29 need not exceed the length of steps which must be performed in conventional apparatus which are designed to produce a single file of pads.

The improved method and apparatus are more economical than the aforediscussed conventional methods and apparatus because the material of the metallic or plastic wire which is used for the making of spirals 93A can be processed without any or with negligible waste. This is due to the fact that the pads 29 of each group at the station for the spiral introducing unit 36 are immediately adjacent to each other, i.e., the spiral 93A is merely severed in regions between neighboring pads 29 of a group and such severing does not or need not entail any waste in the material of the spiral.

The provision of transporting means which includes at least one indexible turret is advantageous because this reduces the overall length of the apparatus, i.e., the overall length of the path along which the constituents of finished pads 29*a* travel from the feeding station 3 to the take-off station TO. The bending of end portions 93B of discrete binders 93 is desirable and advantageous because such deformation of the end portions insures that the end convolutions are not likely to leave the perforations of the respective pads 29*a*. As mentioned above, the end portions 93B are preferably deformed in such a way that they extend in parallelism with the axes of the respective binders 93 and that their tips face each other. In addition, the bending of end portions 93B reduces the likelihood of injury to the hands of persons using the pads 29*a*, to personnel in the manufacturing plant and/or to workmen in charge of stacking, storing, transporting and/or distributing the pads.

The feature that the second section 2 of the path is defined by an indexible conveyor is desirable and advantageous on the additional ground that the aligning units 33, 34, the spiral inserting unit 36 and the severing and deforming unit 37 can be fixedly mounted adjacent to the path of movement of holders 38.

The various mechanisms and drives for imparting movements to transporting means as well as to the mobile components of various units can be of conventional design. Furthermore, the apparatus can be equipped with suitable means for monitoring the movements of components of the pads 29*a* and for producing signals in response to detection of eventual malfunctions. The exact construction of the drives and monitoring means froms no part of the present invention.

The apparatus of the present invention can embody means for moving the registering pads of successive groups apart, e.g., for the purpose of enabling suitable tools to provide the pads with rounded corners or for other purposes. In other words, the sheets 7 and the pads 29 are confined to movement along the aforementioned path between the planes X—X and Y—Y while they undergo those treatments which were described above, namely, assembly of stacks 6, conversion of stacks 6 into stacks 6*a*, perforation of stacks 6*a*, conversion of stacks 6*a* into stacks 6*b*, alignment of perforations 22 in successive groups of registering pads 29, introduction of spirals 93A into successive groups of registering pads 29, severing or trimming of spirals 93A and, if desired, bending of end portions 93B of the thus obtained binders 93.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In a method of assembling and converting elongated spirals and elongated sheets into pads whose leaves are held together by binders each of which constitutes a portion of a spiral, the steps of establishing an elongated path between two substantially parallel planes;

assembling a series of successive first stacks, each consisting of said elongated sheets, in a first portion of said path, including positioning said sheets transversely of the longitudinal direction of said path;

breaking up said first stacks into smaller second stacks in a second portion of said path;

applying a row of perforations to a longitudinally extending edge portion of each second stack in a third portion of said path, said rows of perforations extending substantially at right angles to said planes;

collecting several successive second stacks into larger third stacks in a fourth portion of said path;

subdividing successive third stacks into groups of registering pads in a fifth portion of said path, including severing each third stack in at least one plane which is parallel to said first mentioned planes;

aligning the perforations of successive groups of pads in at least one additional portion of said path;

introducing spirals into the aligned perforations of successive groups of pads in a further portion of said path;

maintaining said rows of perforations substantially at right angles to said first mentioned planes in the course of said collecting, subdividing, aligning and introducing steps; and severing successive spirals in still another portion of said path so that each spiral yields several discrete binders, one for each pad of the respective group.

2. In a method as defined in claim 1, the additional step of bending the free end portions of said discrete binders.

3. In a method as defined in claim 1, wherein said path includes an arcuate section and said additional, said further and said still another portion of said path form part of said arcuate section.

4. In a method as defined in claim 1, wherein each of said binders has two free end portions, the additional step of bending said free end portions of said discrete binders in opposite directions.

5. In a method as defined in claim 1, wherein said path includes a planar section including said first to fifth portions.

6. In an apparatus for assembling and converting elongated spirals and elongated sheets into pads whose leaves are held together by binders each of which constitutes a portion of a spiral, the combination of transporting means defining an elongated path which is disposed between two parallel planes, said path including a first portion for reception of successive first stacks of elongated sheets which extend transversely of said path; means for breaking up successive first stacks into smaller second stacks in a second portion of said path; means for applying a row of perforations substantially at right angles to said planes to a longitudinally extending edge portion of each second stack in a third portion of said path; means for collecting several successive second stacks into larger third stacks in a fourth portion of said path; means for subdividing successive third stacks into groups of registering pads in a fifth portion of said path, including means for severing successive third stacks in at least one plane which is parallel to said first mentioned planes and normal to said rows of perforations; means for aligning the perforations of successive groups of pads in at least one additional portion of said path; means for introducing spirals into the perforations of successive groups of pads in a further portion of said path wherein said rows of perforations are substantially normal to said first mentioned planes; and means for severing successive spirals in still another portion of said path so that each spiral yields several discrete binders, one for each pad of the respective group.

7. The combination of claim 6, wherein each discrete binder includes two free end portions and further comprising means for bending the end portions of said discrete binders.

8. The combination of claim 7, wherein said bending means is disposed in said still another portion of said path.

9. The combination of claim 6, wherein said aligning means includes means for simultaneously aligning the perforations of an entire group of pads.

10. The combination of claim 6, wherein said introducing means includes means for inserting a spiral simultaneously into the perforations of all of the pads of a group in said further portion of said path.

11. The combination of claim 6, wherein said last mentioned severing means includes a plurality of trimming tools all disposed adjacent to said still another portion of said path.

12. The combination of claim 6, wherein said transporting means includes a turret movable about an axis which extends tranversely of said path.

13. The combination of claim 6, wherein said transporting means includes a turret which is indexible about an axis extending transversely of said path and includes holder means for groups of pads.

14. The combination of claim 13, wherein each of said holder means includes a pair of jaws defining a space for a group of pads and means for moving at least one of said jaws toward and away from the other of said jaws.

15. The combination of claim 6, wherein said transporting means includes an indexible turret, said aligning means, said spiral introducing means and said last mentioned severing means being adjacent to said turret.

* * * * *